US007025493B2

(12) United States Patent
Min et al.

(10) Patent No.: US 7,025,493 B2
(45) Date of Patent: Apr. 11, 2006

(54) CHEMICAL SUPPLY SYSTEM AND CHEMICAL MIXING APPARATUS

(75) Inventors: Chung-Ki Min, Suwon (KR); Yong-Sun Ko, Suwon (KR); In-Seak Hwang, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 197 days.

(21) Appl. No.: 10/147,351

(22) Filed: May 17, 2002

(65) Prior Publication Data

US 2002/0191486 A1 Dec. 19, 2002

(30) Foreign Application Priority Data

May 18, 2001 (KR) ..... 2001-27323

(51) Int. Cl.
*B01F 7/00* (2006.01)
*B01F 15/02* (2006.01)

(52) U.S. Cl. ..... 366/168.1; 366/173.1; 366/194

(58) Field of Classification Search ..... 366/168.1, 366/173.1, 194, 184; 210/414, 415, 457
See application file for complete search history.

(56) References Cited

U.S. PATENT DOCUMENTS

| | | | | | |
|---|---|---|---|---|---|
| 3,161,591 | A * | 12/1964 | Petter et al. | ..... | 366/114 |
| 3,527,351 | A * | 9/1970 | Wade | ..... | 210/457 |
| 4,569,756 | A * | 2/1986 | Klein | ..... | 210/193 |
| 4,964,732 | A * | 10/1990 | Cadeo et al. | ..... | 366/152.1 |
| 5,799,643 | A * | 9/1998 | Miyata et al. | ..... | 451/60 |
| 5,855,792 | A * | 1/1999 | Adams et al. | ..... | 210/696 |
| 5,906,737 | A * | 5/1999 | Hoeppner | ..... | 210/232 |
| 6,106,714 | A * | 8/2000 | Chiu et al. | ..... | 451/60 |
| 6,221,246 | B1 * | 4/2001 | Shums | ..... | 210/457 |
| 6,238,279 | B1 * | 5/2001 | Shau et al. | ..... | 451/60 |
| 6,565,422 | B1 * | 5/2003 | Homma et al. | ..... | 451/60 |

* cited by examiner

*Primary Examiner*—Tony G. Soohoo
(74) *Attorney, Agent, or Firm*—Lee & Morse, P.C.

(57) ABSTRACT

A chemical supply system includes at least two supply pipes for supplying at least two different chemicals; a mixing unit connected to the supply pipes for mixing at least two different chemicals to form a chemical mixture, an exhausting unit for exhausing the chemical mixture externally; and a filtering unit provided between the mixing unit and the exhausting unit for filtering the chemical mixture to prevent chemical particles having more than a predetermined size from being exhausted.

19 Claims, 5 Drawing Sheets

CHEMICAL SUPPLY SYSTEM AND CHEMICAL MIXING APPARATUS

BACKGROUND OF THE INVENTION

1. Field of the Invention

The present invention relates to a chemical supply system and a chemical mixing apparatus for use in manufacturing a semiconductor device.

2. Description of Related Art

A variety of different kinds of chemicals, including gaseous chemicals, liquid chemicals and gel chemicals, are used in manufacturing semiconductor devices. During semiconductor manufacture, these chemicals are usually supplied or delivered in the form of a chemical mixture comprising two or more kinds of chemicals that are mixed. Accordingly, efficient mixing and proper filtering of the chemical mixture are important factors in ensuring high quality delivery of the various kinds of chemicals to semiconductor manufacturing processes.

Recently, as the level of integration or density in semiconductor devices has increased, the design rule has become increasingly fine. It is difficult, however, to satisfy such fine design rules using chemicals having a low selecting ratio. Accordingly, chemicals having a high selection ratio have been developed in order to meet the demands and requirements of fine design rules. Such chemicals having a high selection ratio are generally made by mixing two or more different chemicals.

Chemicals having a high selection ratio, however, are prone to exhibiting problems during application in a manufacturing process. For example, defects occur on a surface of a semiconductor wafer during a manufacturing process due to chemicals having a high selection ratio. One of the causes of such defects is due to the generation of large-sized particles when the chemicals become exposed to external air before mixing. Another cause is due to chemical particle growth at dead points in the delivery channel, such as may exist in a tube at joint portions or bending portions.

When a chemical mixture containing such large-sized particles is supplied and used in a deposition process during semiconductor manufacture, there is a high probability that the chemical mixture will not be properly deposited on a semiconductor wafer with a tendency of the chemical mixture to form an overhang. In the case of an etching process, an over-etching occurs at a portion on which large-sized particles are positioned. In the case of a chemical mechanical polishing (CMP) process, fine scratches occur due to the large-sized particles.

SUMMARY OF THE INVENTION

To address and overcome the problems associated with large-size particles as described above, preferred embodiments of the present invention provide a chemical supply system that can minimize the formation and also the supply and delivery of large-sized particles.

It is therefore a feature of an embodiment of the present invention to provide a chemical mixing apparatus that can minimize the formation as well as the supply and delivery of large-sized particles.

In accordance with a feature of a preferred embodiment of the present invention, there is provided a chemical supply system, comprising at least two supply pipes for supplying at least two different chemicals; a mixing unit connected to the supply pipes for mixing at least two different chemicals to form a chemical mixture; an exhausting unit for exhausting the chemical mixture externally; and a filtering unit provided between the mixing unit and the exhausting unit for filtering the chemical mixture to prevent chemical particles having more than a predetermined size from being exhausted. The exhausting unit may be in the form of an outlet pipe.

The mixing unit includes an external housing, wherein one portion of the external housing is connected to one supply pipe and another portion of the external housing is connected to another supply pipe. An inlet pipe having a plurality of inlet holes is floated within the external housing and is coupled to the exhausting unit or outlet pipe. The external housing comprises at least two coupling ports, each coupling port being connected to a supply pipe; and a guiding port for guiding the exhausting unit or outlet pipe from an outlet port of the inlet pipe to the outside of the external housing. The coupling ports, guiding port and the outlet port are sealed with a sealant. The filtering unit is fitted on and over an outer surface of the inlet pipe and filters the chemical mixture before the chemical mixture flows into the inlet pipe through the plurality of inlet holes. The filtering unit may be one of a reverse osmotic pressure filter, a hollow membrane filter, or a carbon filter, although other types of filters, including ceramic filters, are not excluded from the scope of the present invention.

The system further includes at least two chemical reservoirs or storage units for reserving or storing the chemicals; at least one supply pipe connecting each chemical reservoir or storage unit with the external housing; and at least one pump operatively associated with each chemical reservoir or storage unit for pumping the chemicals reserved or stored in each chemical reservoir or storage unit through the supply pipe into the external housing. The pumps may be integral with the chemical reservoirs or storage units or, alternatively, may be installed in the supply pipes.

The system further includes a mixer for mixing the chemicals, and may include a mixing blade assembly and a motor operatively engaged with the mixing blade assembly.

In an alternate embodiment of the present invention, there is provided a chemical supply system, comprising an external housing into which at least two different chemicals flow and mix; an inlet pipe floated in the external housing and having a plurality of inlet holes through which the chemical mixture flows in an inner portion of the external housing; a filter fitted on an outer surface of the inlet pipe and filtering the chemical mixture before the chemical mixture flows into the inlet pipe; and an outlet pipe guiding the chemical mixture in the inlet pipe to the outside of the external housing.

The system further includes a mixer for mixing chemicals inflowing into the external housing. The mixer includes a mixing blade assembly and a motor operatively engaged with the mixing blade assembly for driving the mixing blade assembly. The filter is one of a reverse osmotic pressure filter, a hollow membrane filter or a carbon filter.

BRIEF DESCRIPTION OF THE DRAWINGS

The above features and advantages of the present invention will become more apparent by describing in detail preferred embodiments thereof with reference to the attached drawings in which.

DETAILED DESCRIPTION OF THE INVENTION

Korean Patent Application No. 2001-27323, filed on May 18, 2001, and entitled: "CHEMICAL SUPPLY SYSTEM AND CHEMICAL MIXING APPARATUS," is incorporated by reference herein in its entirety.

Reference will now be made in detail to preferred embodiments of the present invention, an example of which is illustrated in the accompanying drawings.

Figure 1:
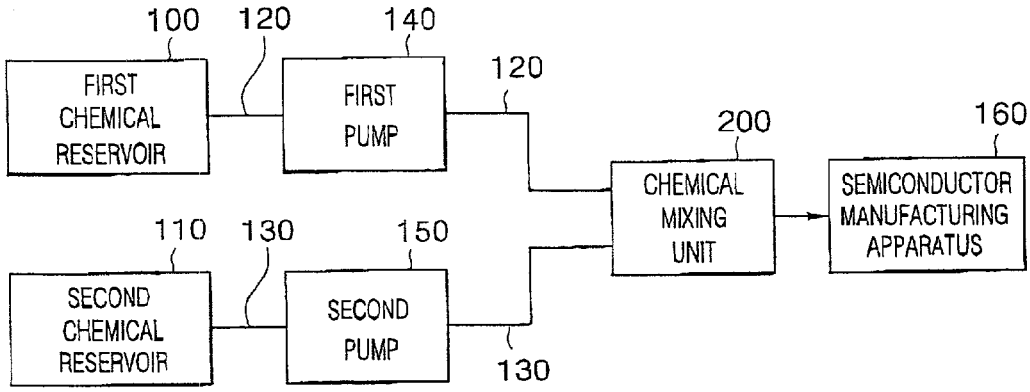
FIG. 1 is a schematic diagram of a chemical supply system according to a preferred embodiment of the present invention.

Referring now to FIG. 1, a chemical supply system according to a preferred embodiment of the present invention includes a first chemical reservoir (or storage unit) 100 reserving or storing a first chemical, a second chemical reservoir (or storage unit) 110 reserving or storing a second chemical. The first and second chemical reservoirs 100 and 110 are reservoir or storage tanks that can safely reserve and hold chemicals. Various different kinds of chemicals may be reserved or stored in the reservoir tanks, including gaseous chemicals, liquid chemicals and gel chemicals.

A first supply pipe 120 extends from the first chemical reservoir 100, and a second supply pipe 130 extends from the second chemical reservoir 110. A first supply pump 140 is installed in the first supply pipe 120 and pumps a chemical reserved in the first chemical reservoir 100 through the first supply pipe 120. A second supply pump 150 installed in the second supply pipe 130 pumps a chemical reserved in the second chemical reservoir 110 through the second supply pipe 130.

The first supply pipe 120 and the second supply pipe 130 are connected to a chemical mixing unit 200. That is, the chemical mixing unit 200 communicates with the first and second chemical reservoirs 100 and 110 through the first and second supply pipes 120 and 130. The chemical mixing unit 200 serves to mix different kinds of chemicals supplied through the first and second supply pipes 120 and 130, respectively.

Figure 2:
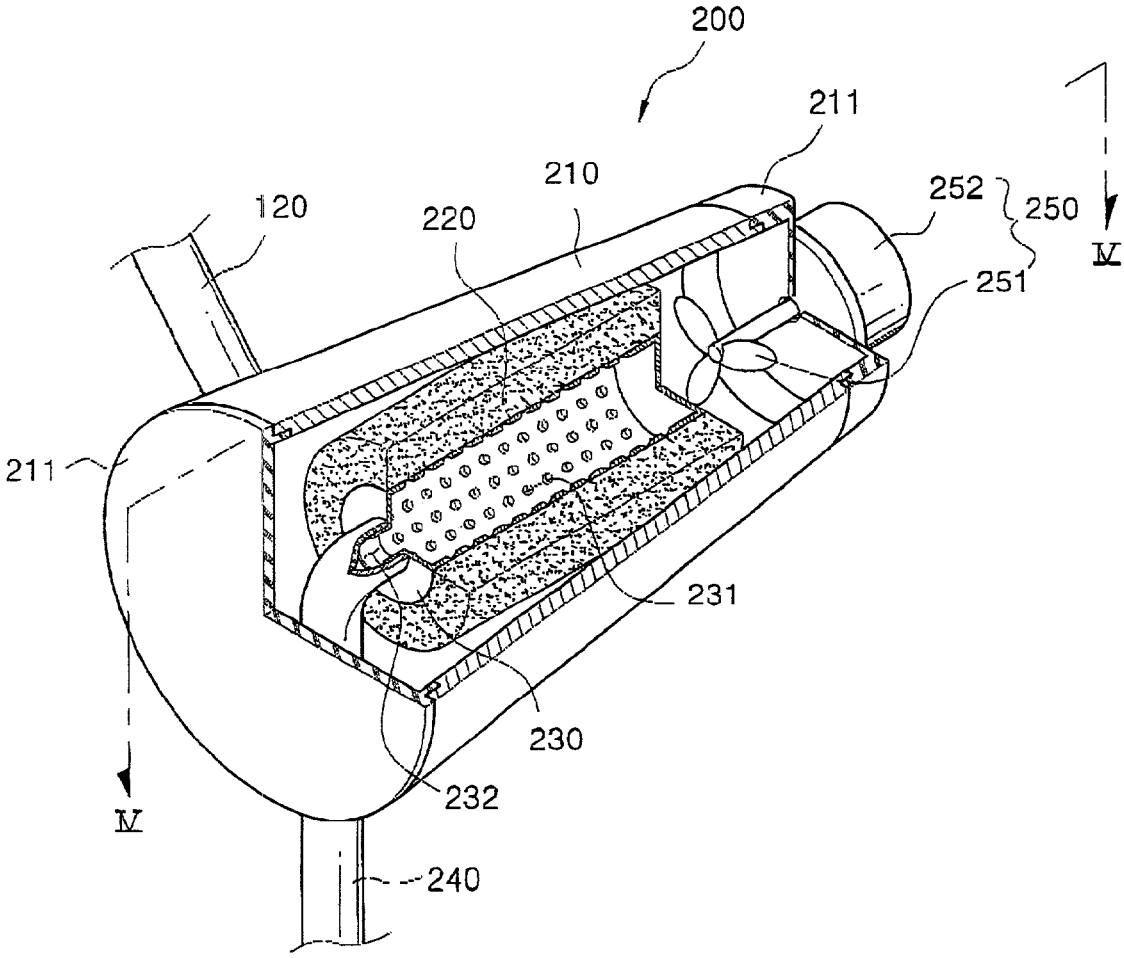
FIG. 2 is a partial cutaway perspective view illustrating a chemical mixing unit shown in FIG. 1.
Figure 3:
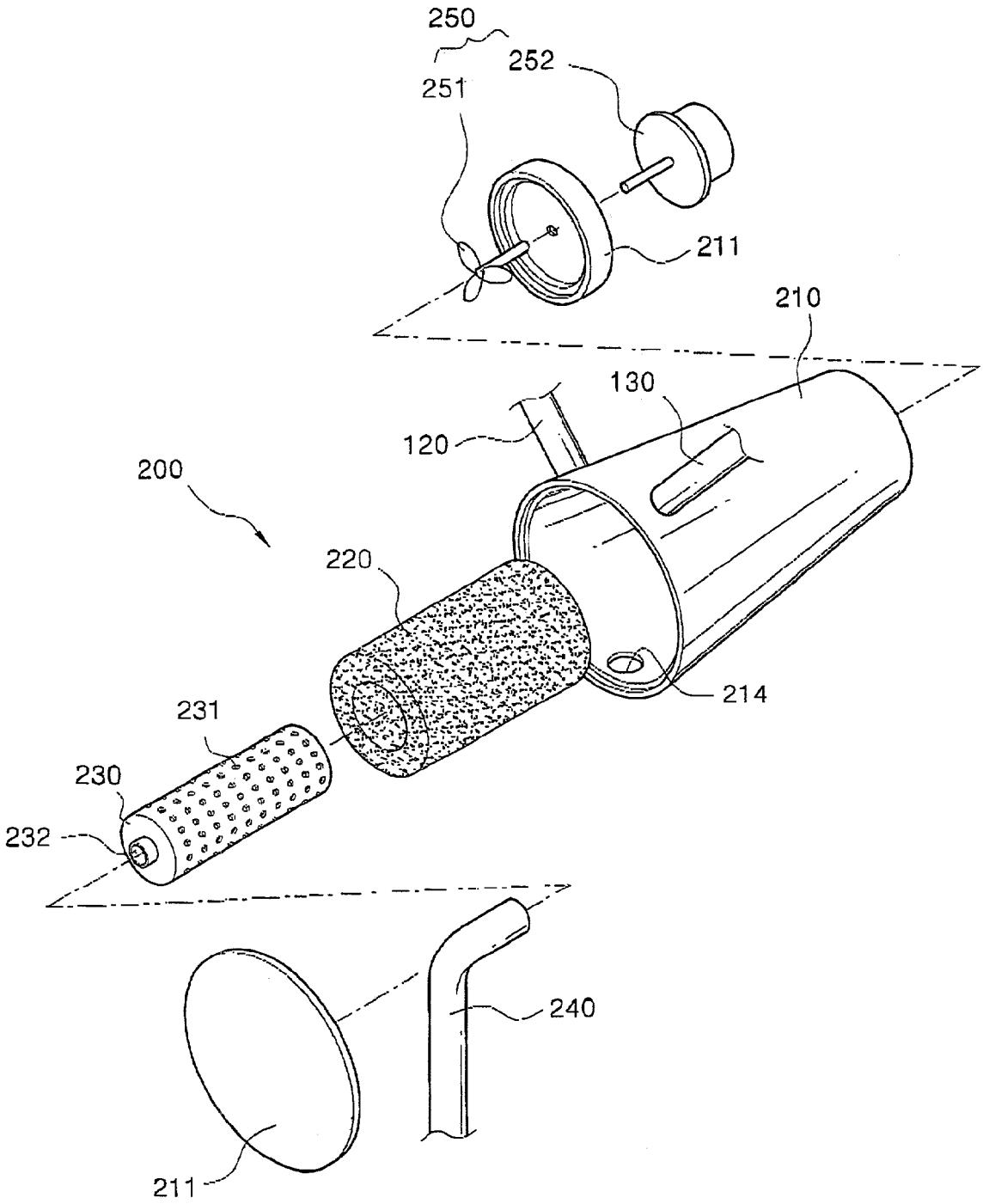
FIG. 3 is an exploded perspective view illustrating the chemical mixing unit shown in FIG. 1.
Figure 4:
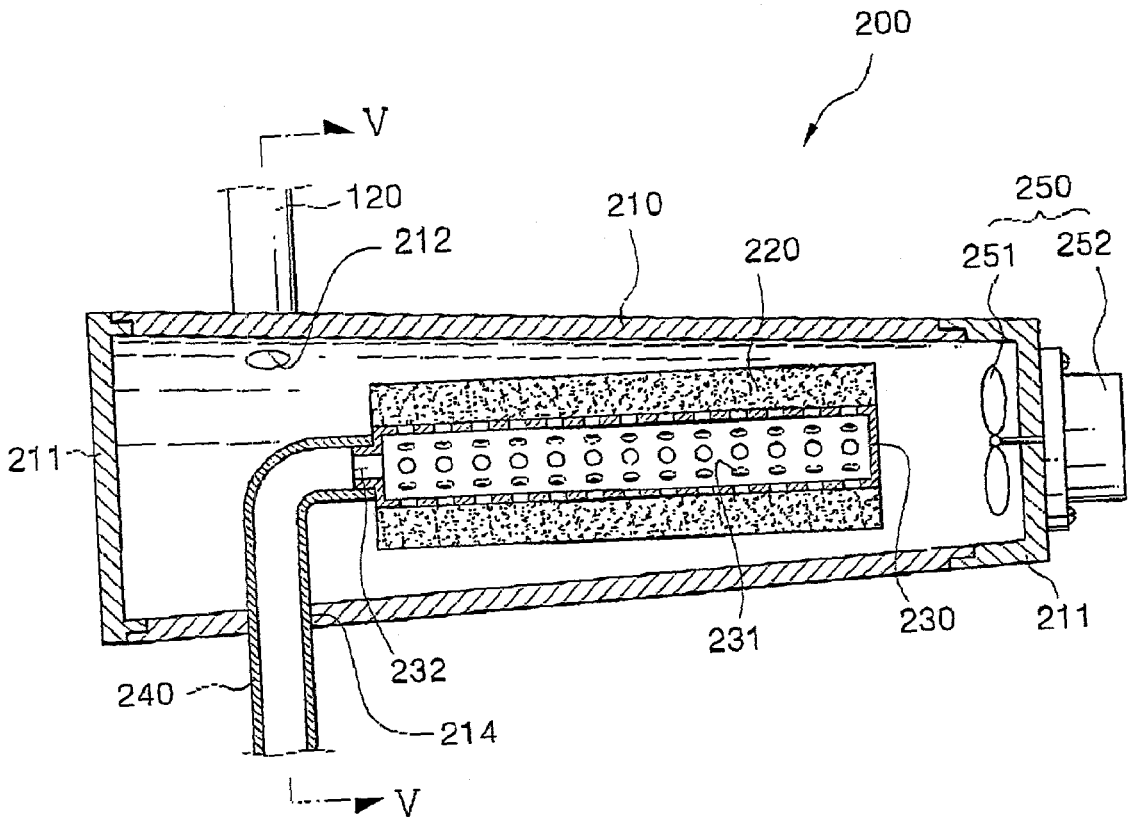
FIG. 4 is a cross-sectional view of the chemical mixing unit taken along line IV–IV' of FIG. 2.
Figure 5:
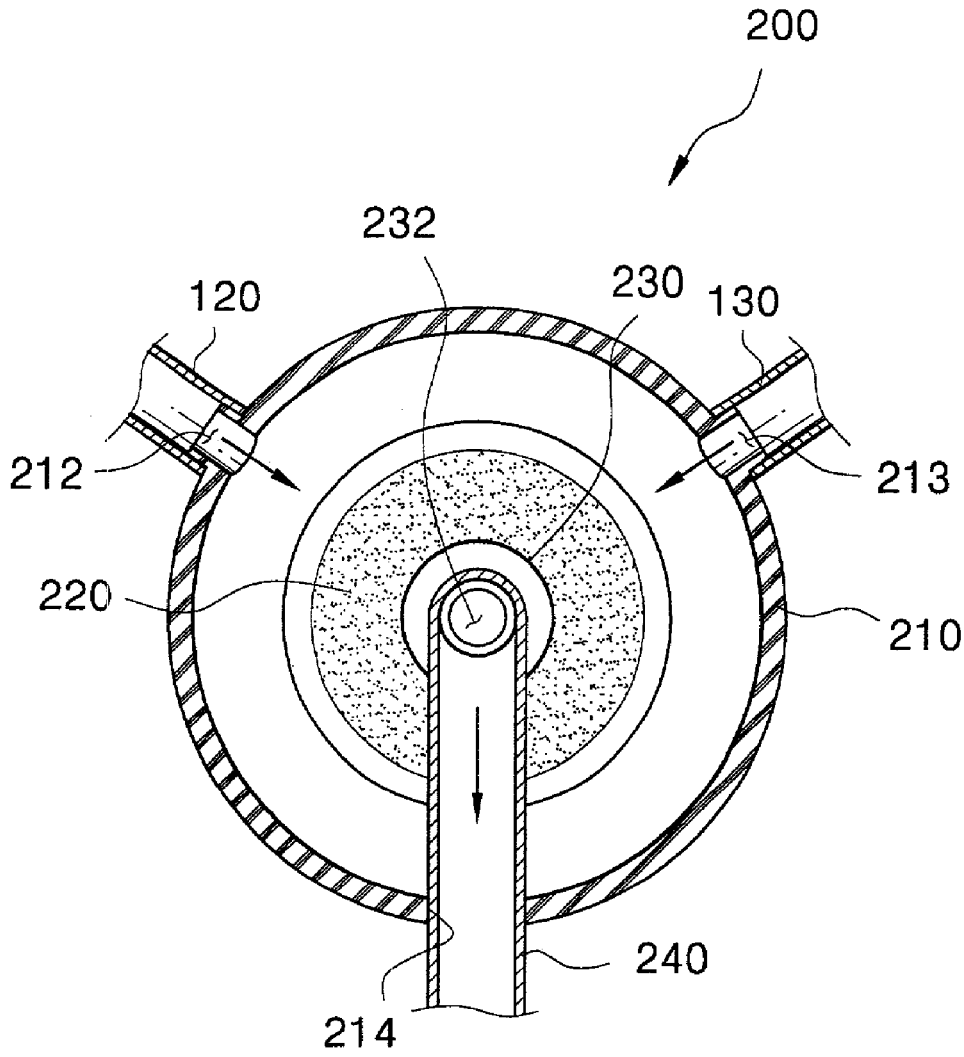
FIG. 5 is a cross-sectional view of the chemical mixing unit taken along line V–V' of FIG. 4.

FIG. 2 is a partial cutaway perspective view illustrating a chemical mixing unit shown in FIG. 1. FIG. 3 is an exploded perspective view illustrating the chemical mixing unit shown in FIG. 1. FIG. 4 is a cross-sectional view of the chemical mixing unit taken along line IV–IV' of FIG. 2. And, FIG. 5 is a cross-sectional view of the chemical mixing unit taken along line V–V' of FIG. 4.

According to a preferred embodiment of the present invention, the chemical mixing unit 200 includes an external housing 210 and an inlet pipe 230. The external housing 210 has a cylindrical shape whose diameter steadily decreases from one end to another end, as shown in FIG. 4. The external housing 210 includes two covers 211 to open a front end portion and a rear end portion thereof. One of the covers 211 can be arranged to open either of the front and rear end portions of the external housing 210. The external housing 210 includes a first coupling port 212 to communicate with the first supply pipe 120 and a second coupling port 213 to communicate with the second supply pipe 130.

The inlet pipe 230 is floated in the external housing 210. The inlet pipe 230 includes an outlet port 232 at one end portion thereof to communicate with an exhausting unit in a preferred form of an outlet pipe 240. The outlet pipe 240 exhausts the chemical mixture from the chemical mixing unit 200 and supplies the chemical mixture to a semiconductor manufacturing apparatus 160. The external housing 210 includes a guide port 214 to guide the outlet pipe 240 from an outlet port 232 to the outside of the external housing 210.

The first coupling port 212, the second coupling port 213, the outlet port 232, and the guide port 214 are sealed using a sealant to hermetically seal the external housing 210 and the inlet pipe 220.

The inlet pipe 230 includes a plurality of inlet holes 231 on a surface thereof to communicate with the external housing 210. Accordingly, a chemical mixture produced by mixing the first chemical and the second chemical in the external housing 210 flows into the inlet pipe 230 through the inlet holes 231.

A filter 220, preferably in the form of a cylindrical sleeve, is fitted on and over an outer surface of the inlet pipe 230. The filter 220 filters a chemical mixture in the external housing 210 before the chemical mixture flows into the inlet pipe 230 to prevent chemical particles having more than a predetermined size from flowing into the inlet pipe 230. The filter medium may be selected from a number of various types of filter media, including a reverse osmotic pressure filter, a hollow membrane filter, a carbon filter and ceramic filters, depending upon and according to nature and properties of the chemical mixture being filtered.

A mixer 250 is provided to one side of the external housing 210 to mix the chemical mixture. In a preferred embodiment of the present invention, the mixer 250 includes a mixing blade assembly 251 and a motor 252 operatively engaged with the mixing blade assembly 251 for driving the mixing blade assembly 251. The mixer 250 can be removed from or attached to the external housing 210, and thus may be used optionally.

In operating the chemical supply system according to a preferred embodiment of the present invention, the first supply pump 140 and the second supply pump 150 operate to supply the first chemical reserved in the first chemical reservoir 100 and the second chemical reserved in the second chemical reservoir 110 through the first supply pipe 120 and the second supply pipe 130, respectively. The first and second chemicals flow into the external housing 210 and are mixed. As indicated earlier, the mixer 250 may be optionally used to mix the first and second chemicals into a chemical mixture.

The chemical mixture of the first and second chemicals then flows into the inlet pipe 230. At this point, particles having more than a predetermined size are filtered by the filter 220. Accordingly, to the extent that large-size particles are formed at dead points of the supply pipes 120 and 130, these large-size particles are filtered and prevented from flowing into the inlet pipe 230 by the filter 220. Thereafter, the chemical mixture in the inlet pipe 230 is exhausted through the outlet pipe 240 and supplied to the semiconductor manufacturing apparatus 160.

To the extent that there may be a tendency of the chemical mixture to be or become insufficiently mixed, the mixer 250 may be deployed to ensure that a uniformly mixed and stable chemical mixture is supplied to the semiconductor manufacturing apparatus 160.

While there has been a description of mixing only two kinds of chemicals to form a chemical mixture used in a semiconductor manufacturing apparatus, the present invention is not limited to only two kinds of chemicals. Three or more kinds of chemicals may also be mixed and supplied using the system and mixing apparatus of the present invention, by modifying the chemical supply system, including the mixing apparatus, depending on the number of chemicals to be mixed. It is also possible to have an external housing having three or more coupling ports, each coupling port connected to different chemical supply pipe. By controlling the flow of each chemical into the external housing, various different chemical mixtures may be obtained.

The inventive chemical supply system can be applied to a variety of semiconductor manufacturing processes such as a depositing process, an etching process, a chemical mechanical polishing (CMP) process, and so on. Of these processes, an exemplarily description of the present inventive chemical supply system as applied to the CMP process is provided below.

A slurry is generally used in the CMP process. It is assumed that a ceria slurry having a high selection ratio is used as a slurry. The ceria slurry includes a $CeO_2$ contained in a deionized wafer as a main reactant and an additive having a high selection ratio. The $CeO_2$ and the additive are separately supplied through the corresponding supply pipes 120 and 130 and mixed in the external housing 210 to prepare a chemical mixture, i.e., a slurry. The slurry is supplied for the CMP process.

At the same time, while the chemicals are supplied through the supply pipes 120 and 130, chemical particles begin to grow at dead points or on non-uniform surfaces to form large-sized chemical particles. While it is possible to reduce the number of these chemical particles in the supply pipes 120 and 130 by minimizing dead points and decreasing non-uniform surfaces, it is fundamentally extremely difficult if not impossible to prevent the formation and growth of these large-sized chemical particles.

In the present invention, however, these large-sized or over-grown chemical particles are filtered by the filter 220, and the slurry mixture that is finally supplied to the CMP process does not contain any large-sized or over-grown chemical particles.

As described herein before, the chemical supply system according to the present invention filters the large-sized or over-grown chemical particles and supplies a chemical mixture to the semiconductor manufacturing apparatus, thereby improving a manufacturing yield.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A chemical supply system, comprising:

at least two supply pipes for supplying at least two different chemicals;

a mixing unit connected to the supply pipes for mixing at least two different chemicals to form a chemical mixture, the mixing unit including:

an external housing wherein the at least two different chemicals are combined and filtered, one portion of the external housing being connected to one supply pipe and another portion of the external housing being connected to another supply pipe, and an inlet pipe having a plurality of inlet holes floated within the external housing and coupled to an exhausting unit;

the exhausting unit positioned at least partially inside the mixing unit for exhausting the chemical mixture externally; and a filtering unit provided between the mixing unit and the exhausting unit for filtering the chemical mixture to prevent chemical particles having more than a predetermined size from being exhausted from the external housing, wherein the at least two supply pipes and an outlet pipe are installed at a first end of the external housing, a mixing fan is installed at a second end of the external housing, and a diameter of the external housing steadily decreases from the first end to the second end.

2. The chemical supply system as claimed in claim 1, wherein the external housing comprises:

at least two coupling ports, each coupling port being connected to a supply pipe; and a guiding port for guiding the exhausting unit from an outlet port of the inlet pipe to the outside of the external housing.

3. The chemical supply system as claimed in claim 2, wherein the coupling ports, guiding port and the outlet port are sealed with a sealant.

4. The chemical supply system as claimed in claim 1, wherein the filtering unit is fitted on an outer surface of the inlet pipe and filters the chemical mixture before the chemical mixture flows into the inlet pipe.

5. The chemical supply system as claimed in claim 4, wherein the filtering unit is one of a reverse osmotic pressure filter, a hollow membrane filter or a carbon filter.

6. The chemical supply system as claimed in claim 1, further comprising at least two chemical reservoirs for reserving the chemicals;

at least one supply pipe connecting each chemical reservoir with the external housing; and at least one pump operatively associated with each chemical reservoir for pumping the chemicals reserved in the chemical reservoirs through the supply pipe and into the external housing.

7. The chemical supply system as claimed in claim 6, wherein the pumps are installed in the supply pipes.

8. The chemical supply system as claimed in claim 1, further comprising a mixer for mixing the chemicals.

9. The chemical supply system as claimed in claim 8, wherein the mixer includes a mixing blade assembly and a motor operatively engaged with the mixing blade assembly.

10. The chemical mixing apparatus as claimed in claim 1, wherein the external housing is tapered from a first end to a second end.

11. A chemical supply system, comprising:

an external housing into which at least two different chemicals flow, wherein the at least two different chemicals are combined and filtered;

an inlet pipe floated in the external housing and having a plurality of inlet holes through which the chemical mixture flows in an inner portion of the external housing;

a filter fitted on an outer surface of the inlet pipe and filtering the chemical mixture before the chemical mixture flows into the inlet pipe; and an outlet pipe guiding the chemical mixture in the inlet pipe to the outside of the external housing, wherein a first supply pipe, a second supply pipe and an outlet pipe are installed at a first end of the external housing, a mixing fan is installed at a second end of the external housing, and a diameter of the external housing steadily decreases from the first end to the second end.

12. The chemical supply system as claimed in claim 11, further comprising a mixer for mixing chemicals inflowing into the external housing.

13. The chemical supply system as claimed in claim 12, wherein the mixer includes a mixing blade assembly and a motor operatively engaged with the mixing blade assembly.

14. The chemical supply system as claimed in claim 11, wherein the filter is one of a reverse osmotic pressure filter, a hollow membrane filter or a carbon filter.

15. The chemical mixing apparatus as claimed in claim 11, wherein the external housing is tapered from a first end to a second end.

16. A chemical mixing apparatus, comprising:

an external housing, wherein a first chemical and a second chemical are combined and filtered;

a first supply pipe for supplying the first chemical to the external housing;

a second supply pipe for supplying the second chemical to the external housing;

a mixing fan installed in the external housing, the mixing fan mixing the first chemical and the second chemical in the external housing to form a chemical mixture;

a motor for driving the mixing fan;

an inlet pipe having a plurality of inlet holes, the inlet pipe being floated in the external housing;

a filter for filtering the chemical mixture before the mixture flows into the inlet pipe, the filter being fitted on an outer surface of the inlet pipe; and an outlet pipe for guiding the chemical mixture in the inlet pipe to the outside of the external housing, wherein the first supply pipe, the second supply pipe and the outlet pipe are installed at a first end of the external housing, the mixing fan is installed at a second end of the external housing, and a diameter of the external housing steadily decreases from the first end to the second end.

17. The chemical mixing apparatus as claimed in claim 16, wherein the motor is installed outside of the external housing.

18. The chemical mixing apparatus as claimed in claim 16, wherein the filtering unit is one of a reverse osmotic pressure filter, a hollow membrane filter or a carbon filter.

19. The chemical mixing apparatus as claimed in claim 16, wherein the external housing is tapered from a first end to a second end.

* * * * *